US008890393B2

(12) United States Patent
Krauss et al.

(10) Patent No.: US 8,890,393 B2
(45) Date of Patent: Nov. 18, 2014

(54) SPARK GAP HAVING A PLURALITY OF SERIES-CONNECTED INDIVIDUAL SPARK GAPS, WHICH ARE LOCATED IN A STACK ARRANGEMENT

(75) Inventors: Bernhard Krauss, Berg/Unterrohrenstadt (DE); Michael Waffler, Neumarkt/Opf. (DE); Arnd Ehrhardt, Neumarkt/Opf. (DE); Stefanie Schreiter, Neumarkt/Opf. (DE); Steffen Beier, Neumarkt/Opf. (DE)

(73) Assignee: DEHN + SÖHNE GmbH + Co. KG, Neumarkt/Opf. (DE)

( * ) Notice: Subject to any disclaimer, the term of this patent is extended or adjusted under 35 U.S.C. 154(b) by 87 days.

(21) Appl. No.: 13/879,679

(22) PCT Filed: Oct. 17, 2011

(86) PCT No.: PCT/EP2011/068081

§ 371 (c)(1), (2), (4) Date: Jul. 10, 2013

(87) PCT Pub. No.: WO2012/052388

PCT Pub. Date: Apr. 26, 2012

(65) Prior Publication Data

US 2013/0278129 A1 Oct. 24, 2013

(30) Foreign Application Priority Data

Oct. 22, 2010 (DE) ..... 10 2010 049 313
May 31, 2011 (DE) ..... 10 2011 102 864

(51) Int. Cl.
*H01J 7/24* (2006.01)
*F02M 57/06* (2006.01)
*F02P 13/00* (2006.01)
*H01T 4/16* (2006.01)

(52) U.S. Cl.
CPC ..... *H01T 4/16* (2013.01)
USPC ..... 313/10; 313/11; 313/11.5; 313/118; 313/123

(58) Field of Classification Search
None
See application file for complete search history.

(56) References Cited

U.S. PATENT DOCUMENTS 2,298,114 A 10/1942 Estorff ..... 315/59
4,029,997 A 6/1977 Wittel ..... 361/129

FOREIGN PATENT DOCUMENTS

CH 210132 6/1940 ..... H01T 4/20
CH 215001 5/1941 ..... H01T 4/20

(Continued)

OTHER PUBLICATIONS

Notification Concerning Transmittal of International Preliminary Report on Patentability (Chapter I of the Patent Cooperation Treaty), in English, dated May 2, 2013, Written Opinion of the International Searching Authority, in English (May 2, 2013—mailed with Notification Concerning Transmittal), and International Preliminary Report on Patentability (Chapter I of the Patent Cooperation Treaty), in English, dated Apr. 23, 2013, and International Search Report (in English) dated Dec. 28, 2011, each of which was issued by the International Bureau of WIPO for corresponding PCT Application No. PCT/EP2011/068081, filed on Oct. 17, 2011.

*Primary Examiner* — Natalie Walford
(74) *Attorney, Agent, or Firm* — Gerald T. Bodner

(57) ABSTRACT

The invention relates to a spark gap comprising a number of series-connected individual spark gaps which are placed in a stack arrangement, which are spaced apart from each other by insulating material discs and are provided with a spring contact, the individual spark gaps including ring-shaped or disc-shaped electrodes, and further comprising control elements for influencing the voltage distribution over the stack arrangement. According to the invention the ring-shaped or disc-shaped electrodes required to form one of the respective individual spark gaps are each inserted into an insulating body and held by same in a centered manner. The respective insulating material discs are located between and fixed by the insulating bodies. A recess is provided inside the insulating body to receive and center the electrodes, whose shape is complementary relative to the contour of the respective electrode, wherein the recess comprises on the inner circumference at least partially elastic, resilient centering projections or centering noses.

15 Claims, 4 Drawing Sheets

(56) References Cited

FOREIGN PATENT DOCUMENTS

Figure 1:
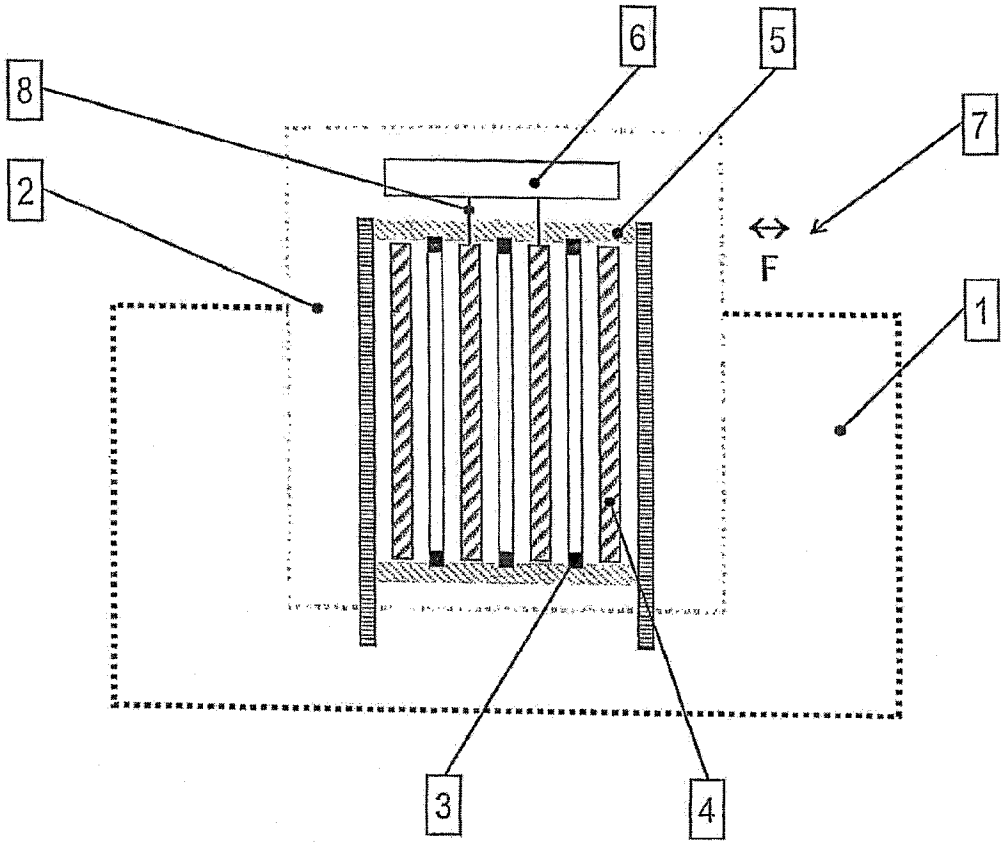

| | | | |
|---|---|---|---|
| CH | 252433 | 12/1947 | H01T 4/20 |
| CN | 101090197 | 12/2007 | H01T 4/16 |
| DE | 395286 | 5/1924 | H01C 7/12 |
| DE | 737825 | 7/1943 | H01T 4/20 |
| DE | 1256306 | 12/1967 | H01T 4/16 |
| DE | 2364034 | 7/1975 | H01T 2/02 |
| DE | 10114592 | 9/2002 | H01T 4/16 |
| EP | 0905840 | 3/1999 | H01T 4/16 |
| WO | WO82/00926 | 3/1982 | H01T 4/16 |

SPARK GAP HAVING A PLURALITY OF SERIES-CONNECTED INDIVIDUAL SPARK GAPS, WHICH ARE LOCATED IN A STACK ARRANGEMENT

The invention relates to a spark gap comprising a number of series-connected individual spark gaps which are placed in a stack arrangement, which are spaced apart from each other by insulating material discs and are provided with a spring contact, the individual spark gaps including ring-shaped or disc-shaped electrodes, and further comprising control elements for influencing the voltage distribution over the stack arrangement, according to patent claim 1.

In known direct current applications the arc current has to be forced to zero by increasing the arc voltage demand to values greater than the available mains voltage (direct current quenching principle). Proceeding from the generally known arc equation, according to which the overall arc voltage is obtained from the sum of the anode/cathode drop voltage and the product of arc length and arc field strength, different starting points are gained for increasing the arc voltage in question.

A particular effective option is the series connection of a number of partial arcs, and thus the summing up of the anode/cathode drop voltages. This physical principle of the series connection of several spark gaps has already been used for a long time for medium voltage arresters. In DE 395 286 an arrester is described, which is comprised of two or more disc-shaped resistor bodies that are in contact with each other. Each resistor body has one or more ribs or elevations, respectively, which have a substantially higher specific resistance than the rest of the mass of the disc. The height of the rib or ribs and, thus, the distance between the individual electrodes ranges between 0.02 mm and about 0.4 mm. Only a few points of contact are provided between the discs, which introduce the spark-over and allow the spark discharge to propagate rapidly over the entire surface of the disc.

The ribs being made of a material with an increased specific resistance are produced during the production of the electrode discs, e.g. by oxidation. This production method is very complicated if the necessary tolerances are observed. In addition, this arrester has no control elements so that the response voltage and the residual voltage are the sum of the individual values of the partial spark gaps and the desired demands to a minimum residual voltage cannot be complied with.

In the previously known stack arrangements without auxiliary means for controlling the voltage over the individual partial spark gaps a voltage overload frequently occurred, and/or an undesired response of the "weakest" element and, thus, a fast failure of individual components or of the arrester as a whole.

To be able to prevent the above-mentioned failures additional elements were parallel-connected to such stack arrangements later in order to homogenize the voltage distribution over the individual partial spark gaps and, thus, improve the arrester in respect of its response behavior. An arrangement including control elements is described, for instance, in WO 1982/00926. The known prior art introduced there relates to the parallel connection of linear, non-linear and/or capacitive resistors, in order to obtain a voltage distribution as uniform as possible over the individual partial spark gaps which are series-connected.

As an alternative to a uniform voltage distribution over the individual partial spark gaps DE 737 825 proposes a multiple protective spark gap for high-voltage systems as coarse protection against overvoltages, characterized in that an auxiliary spark gap and an impedance provided in series therewith (capacitor, voltage-dependent or voltage-independent resistor) is provided to achieve a strongly curved behavior of the surge characteristic of the protective spark gap, which is connected in parallel to at least one of the spark-over gaps of the protective spark gap and controls the voltage distribution on the series-connected spark-over gaps in such a way that a voltage value higher than the voltage portion assigned to it occurs on at least one of same. The protective spark gap is subdivided into such a number of spark-over gaps that the operating frequency current flowing over the spark-over gaps when the protective spark gap responds is quenched automatically.

Other control possibilities by means of capacitances or impedances are known, inter alia, from the documents CH 252 433 A, CH 210 132 A, DE 23 64 034 C3 and CH 215 001 A.

When utilizing the known stacking principle, with the aid of control elements, for the use in low-voltage systems supplemental requirements have to be taken into account, inter alia in view of the lightning surge current carrying capacity, the protection level and the construction size. For applications in low-voltage systems the insulation coordination of the individual elements relative to each other has to be considered, so that a clearly smaller protection level is required as compared to medium- or high-voltage systems. On account of the lightning surge current carrying capacity of the pulse shape 10/350 us, which is likewise required in low-voltage systems, the arrester has to be dimensioned such that the occurring high specific energy can be safely diverted. To this end, not ribs made of a material that has a higher specific resistance are mounted onto the electrodes as spacers, but a stack arrangement consisting of disc-shaped electrodes and insulating spacers is utilized, as is described for instance in DE 1 256 306 B or U.S. Pat. No. 2,298,114.

A stack arrangement of this type consists of a succession of disc-shaped electrodes with insulating rings that are radially projecting over the electrodes. The electrodes are frequently made of graphite. The entire stack is interlocked using several guide rods in an axial direction by screwing. The guide elements and holders serve the radial positioning of the graphite discs and the insulating rings relative to each other, so that projections as reproducible as possible are obtained for the outer spark-over gaps. The guide elements are to be designed such that the radial tolerances of all disc electrodes or rings are taken into account and that guiding the individual components by the axial interlocking of the stack does not result in interruptions of the pressure chain, i.e. in the formation of gaps, or that individual components are not damaged by the screwing. A wrong interlocking may not only lead to a gap formation, by which an increase of the protection level is inevitable due to the additional spark-over gaps, but also to the breakage of the electrodes or bending or shortening of the insulation projections. On account of the unavoidable radial and axial tolerances, in particular with an increasing number of individual elements, this kind of positioning leads to considerable problems with respect to the desired exact positioning of these elements relative to each other. This also refers to the exact observation of the necessary projections between the insulating elements and electrodes. Such displacements along the radial axis are hardly avoidable, however, even in a new condition, as the pressure axis obtained by the screw connection can only act over the sum of the entire stack. The number of the realizable partial spark gaps is therefore strongly limited in the previously known embodiments.

If one additionally bears in mind that corresponding to their basic function, the diverting of pulsed currents, all components of the arrester are exposed to increased mechanical and thermal loads, generally an initially reversible, and then irreversible loosening of the stack, and thus displacement of the individual elements as a result of pressure waves, which depend on the intensity and number of the loads, is unavoidable. These disadvantages are even intensified by the heretofore known embodiments involving the flow of a follow current, resulting in additional thermal and mechanical loads on the arrangement.

Apart from the displacement, moreover, an uncontrolled contamination of the insulating elements, in particular the radial projections in the outer region occurs as a result of the burn-off products. In particular, the thermal load causes damage to the insulating elements of the stack. The commonly used insulating rings made of PTFE tend to become fluid, in particular upon such a thermal load and/or pressure caused by interlocking the stack. These material properties also loosen the pressed condition of the stack so that gaps may be caused between the individual elements. Thus, a further loosening is caused by an uncontrolled, in particular radial displacement of the individual elements.

Also, the insulating rings may be ripped radially, or even torn completely as a result of the mechanical and thermal loads, which may lead to ionized gases escaping into the outer insulation region of the stack arrangement or even to a cancellation of individual isolating gaps due to the displacement of the insulating ring, and thus to the short-circuiting of individual partial spark gaps. Even if the isolating gaps are made of other materials, e.g. ceramics, there is the risk of breakage in the already pressed condition on account of the dynamic loads, so that eventually analogous failures may occur.

Owing to the space conditions inside standardized series installation housings and the type of stack arrangement the vertical and horizontal projections of the previously known arresters are very small anyhow. At very steep voltage rise rates, e.g. in the case of follow-lightnings or switching operations, an external spark-over may occur in these small projection arrangements. Due to the already described and uncontrollable effects induced by displacement and/or contamination these partial or complete external spark-overs of the isolating gaps of the stack may occur in the prior solutions even at low voltage rise rates.

The control boards known so far in the prior art are fixed to the graphite discs by means of clamping contacts. In this case, too, the displacement of the components, ageing and partially even burn-off result in the loosening or even gap formation at these contacts, with the result of inevitable sparking at the junction to the control board. In addition to the other effects this sparking, which was unavoidable in prior arrangements, additionally ionizes the direct external insulation region of the stack, so that the critical external spark-overs already described above are additionally encouraged or directly ignited.

However, the sparking not only results in external spark-overs of the stack, but also in spark-overs on the printed circuit boards on which the control elements are disposed and which are critical in terms of spark-overs anyhow. These individual control elements and the distances on the known printed circuit boards of the currently available arrangements do not have the electric strength between the individual spark gaps required relative to the total residual voltage of the arrester, i.e. the maximum voltage that may occur over the arrester as a whole. In the event of steep voltage rise rates, ignition delay of individual spark gaps, damages to individual isolating gaps or components the insufficient electric strength may be rapidly exceeded. This may result in an overload of the total arrester.

CN 101090197 A discloses a stack arrangement of individual electrodes for low-voltage, comprising an electrical indicator and external control and ignition aids. At least one fuse or thermal fuse is provided in the current path of the control aid or ignition aid, respectively. A calculation formula for the respectively required and equal control capacitances is provided.

Furthermore, the current of the control or ignition aid as well as the temperature in the region of the control or ignition aid are monitored. In this embodiment the thermal coupling to the components concerned is insufficient, however, so that only a limited evaluation of the thermal condition of the spark gap is possible.

In addition, the electrical indicator requires its own energy supply. The additional components affect the function of the control and ignition aid, respectively, and have to be voltage-proof themselves. Despite the different embodiments of the contacting types a spark-free control cannot be ensured, and the integration of an error-prone board is necessary.

In EP 0 905 840 B1 a multiple spark gap with an ohmic, linear or non-linear resistor configuration is introduced, wherein the first spark gap is designed such and whose anode and cathode are spaced apart such that a relatively "low" response voltage for instance of a maximum of 4 kV is obtained. The resistance values of the chain of resistors decrease preferably logarithmically in the direction of through-connection. In this case, too, the contacting is realized by contact springs at the electrodes, which are preferably formed of cylindrical or rectangular, sharp-edged elements. For positioning the individual elements such an arrangement of the control elements always requires an external board with the freely arranged contact springs. This contact-making, which is not always free of sparks, may also affect all other partial spark gaps of the arrester, and the control elements would have to be sufficiently voltage-proof. Moreover, a complicated construction and error-prone production is necessary to allow an adequate centering and, thus, observance of the necessary air gaps and slide distances.

DE 101 14 592 A1, too, proposes a calculation formula for dimensioning the control capacitors. The document describes a spark gap capable of carrying lightning currents and including a number of series-connected spark gaps interconnected with impedances, in particular capacitors, so that the partial spark gaps are connected through successively. The impedances used have identical dimensions. Optionally, varistors may be assigned to the individual partial spark gaps in parallel, allowing to maintain the required protection level also in the event of negative follow-lightnings. The carrying and quenching of the mains follow current is described as one of the most important basic functions of the arrester. To realize the embodiment described control elements arranged on a board are utilized, the contacting of which is insufficient.

The disadvantages of the constructions of known arresters and the uncontrollable ageing only have a minimum influence on the common response voltage of the arrester which is relevant in standard testing. The residual voltage of the arrester relevant for the protection of the system in practice becomes nearly uncontrollable, however, so that a danger to the system cannot be precluded. Apart from this drawback also the ratio of response voltage to residual voltage of the known arrester configuration is quite unfavorable and deteriorates with an increasing number of partial spark gaps.

The spark gap technologies based on the horn principle or expulsion tube principle frequently utilized for direct current applications so far have the disadvantage that, technology-induced, a surge current load is always followed by the flow of a mains follow current. Constructively, this current flow cannot be avoided, but only limited in time, as it is led to zero in accordance with the above-described direct current quenching principle. Nevertheless, all components of the spark gap are loaded both thermally and mechanically during this period, and the arrester is unavoidably subjected to ageing. In order to allow the realization of a behavior that is as stable as possible in terms of ageing during the predetermined period of application, the constructions of such lightning arresters have to take into account these loads and the ageing and burn-off associated therewith, e.g. of the inserted insulating elements.

In the known products, which are configured not to be follow-current-free, for instance the flow characteristics of cost-intensive PTFE used as isolating gap material have to be considered, as this material is plastically deformed under the influence of heat, e.g. by the flow of the follow current, and the constantly applied pressure resulting from the screw connection of the stack arrangement, so that individual isolating gaps may be short-circuited. It is impossible to detect and indicate such adverse effects due to the insufficient thermal coupling of possibly provided protective devices, so that upon another load the partly molten edges of the isolating gap material may be torn off, with the consequence that the junction between the two electrodes is no longer defined and free from gaps, and the undesired increase of the protection level is unavoidable.

Based on the foregoing it is therefore the object of the invention to provide a further developed spark gap comprising a number of series-connected individual spark gaps which are placed in a stack arrangement, which are spaced apart from each other by insulating material discs, and which is characterized by a simple and error-resistant structure and safe assembly, and avoids the aforementioned disadvantages. The spark gap is to be realized in a follow-current-free configuration and controlled by means of voltage-proof control impedances electrically insulated from each other. The spark gap according to the invention not only ensures a safe mode of operation, but is to minimize the probability of having a chain reaction of an external spark-over of partial gaps during high voltage rise rates, despite ageing.

The solution to the object of the invention is achieved by a spark gap comprising a number of series-connected individual spark gaps which are placed in a stack arrangement according to the combination of features defined in patent claim 1. The dependent claims define at least useful embodiments and further developments.

It should be noted at this point that the individual spark gaps are each formed of two disc electrodes which are spaced apart from each other by a disc made of an insulating material. The disc electrodes are guided in an insulating body and respectively connected inside this body by a spring contact to an integrated control element. From this follows that the individual partial spark gaps, which are connected in series, are each formed of two insulating material elements each with an integrated disc electrode, and are spaced apart from each other by an insulating material disc which is made, for instance, of vulcanized fiber. This insulating material disc, which is arranged between two disc electrodes or two insulating material elements, respectively, defines with its circular recess the required distance or spark-over gap for a corresponding partial spark gap on the one hand, and a sufficient projection in the marginal area, on the other hand, so as to avoid an undesired external spark-over.

An insulating material element each includes a disc electrode and spring elements for contacting the control element. Through the spring elements the control element is respectively connected to the disc electrode and the guide element, and is preferably enclosed on all sides by the insulating material element. This may be realized, for instance, by an insertion pocket or, according to the exemplary embodiment described below, by a film hinge. This quasi enclosing integration of the control element in the insulating material element, and the insulation of the contact connections from each other serves to reduce the danger of undesired externals spark-overs.

The spark gap according to the invention, which can preferably be utilized for direct current applications, is based on a stack arrangement of individual electrodes known per se, with an external control of the potential by means of impedances. The number of the isolating gaps is chosen such that up to the admissible maximum operating voltage the behavior of the spark gap is quasi follow-current-free when it responds. The construction of the spark gap is simple and cost-efficient, and can be adjusted to the respective low-voltage level in a modular manner. The invention allows to achieve the goal of a minimum residual voltage and a simple assembly method.

The required functional elements of the partial spark gaps, such as graphite discs with control elements and isolating gaps, are designed as individual modules and are not subjected to function-related loads like pressure, sooting etc., so that the obtained spark gap as a whole has a high quality and is stable in terms of ageing.

According to the invention the ring-shaped or circular electrodes required to form one of the respective individual spark gaps are each inserted into an insulating body and held by same in a centered manner, with the respective insulating material disc being located between and fixed by the insulating bodies. A recess is provided inside the insulating body to receive and center the electrodes, whose shape is complementary relative to the contour of the respective electrode. The recess comprises on the inner circumference at least partially elastic, resilient centering projections or centering noses. By the respective assignment of the control elements and a suitable centering of the individual disc electrodes and the insulating material discs located there between the displacement of the functionally relevant individual elements relative to each other is avoided. Thus it is possible to realize a reliable pressure contact of the individual partial spark gap elements and, thus, of the arrester function as a whole.

These centering projections or centering noses may be formed during the production of the insulating body, e.g. integrally formed by means of a molding technique.

The respective insulating bodies comprise a radial prolongation or a corresponding lug which receives at least one contact spring for contacting the respective electrode in particular at the edge. The contact spring projects at least partially into the recess so as to ensure the desired contact with the electrode.

The respective insulating body comprises a film hinge part, in particular in the region of the radial prolongation, which can be moved from an opened position into a closed position.

The film hinge part includes at least one hole or opening to receive at least one of the respective control elements.

This hole or opening may be of a different geometric design for correspondingly different confusion-proof control elements.

The at least one of the respective control elements is electrically coupled through the at least one contact spring. Thermally and mechanically susceptible solder connections may be waived.

At the radial prolongation of the insulating body, spaced apart from the contact spring, a receptacle for another spring-type contact element is provided. The distance and the position between the end of the contact spring away from the electrode and the second contact element corresponds to the position of the connections of the respective control element.

The second contact element may, in this case, extend into a recess space which receives one of the elements connecting the stack arrangement, e.g. a rivet or a screw. This ensures a corresponding contact and the formation of a series connection of the stack arrangement in a simple way.

According to the invention the centering by the centering noses or centering projections provides for a circumferential air gap between the respective electrode and the respective insulating body. This gap serves as a pressure compensation space and defines an area for the selective, non-interfering sooting. If required, additional vent channels may be integrated in the construction.

In addition, complementary position-securing projections and/or recesses are formed, in particular integrally formed, on the insulating bodies on the upper and lower sides in the stack.

The insulating material discs include an opening pointing to the respective electrodes to form a distance gap or isolating gap. The outer isolating gap, which is necessary as well, is ensured by a sufficient overlap in the marginal area relative to the disc electrode.

Furthermore, in one embodiment, the insulating material discs include an extension section with an adjustment recess, which likewise serves to secure the position in the stacked assembly.

In a preferred embodiment the insulating material discs each have a thickness of about 300 μm and are made, for instance, from a vulcanized fiber material.

At least parts or portions of the insulating body are made of a thermally conducting plastic material so that the thermal energy generated in the event of a spark-over can be discharged safely and fast to the outside.

The electric strength of the control elements is chosen to be greater than or equal to the maximally occurring protection level.

The impedance values of at least some of the respective control elements are five to ten times greater than the longitudinal capacitance of the stack arrangement.

The insulating bodies may be at least partially color-coded so as to avoid confusions with respect to their arrangement in the stack arrangement and series connection.

In one embodiment of the invention a thermally sensitive overload indicator is provided, designed, for instance, as a soldered disconnection point.

The response voltages of the individual spark gap are less than 1500 V. The aforementioned circumferential centering noses or centering projections, which represent spring elements, serve compensation purposes in the event of pressure loads on the stack. In another modification it is possible to design the control elements and the contacts thereof as inserts for an injection molding process.

The impedance values of the individual control elements may be dimensioned in dependence on the specific mechanical construction and/or in view of the materials utilized. As was explained, the impedance value of the control elements is five to ten times greater than the longitudinal capacitance of the arrangement, wherein the impedance value of the last partial spark gap is, on an average, again higher by the factor five to ten times than that of the other control elements. According to the inventive solution a ratio of residual to response surge voltage of less than 2.5 is obtained.

In a preferred embodiment a so-called Tox clinch technology, i.e. clinching, is used for the contact with an external connection, if required in connection with a tolerance compensation surface.

The invention will be explained in more detail below by means of an exemplary embodiment and with the aid of figures.

Figure 2B:
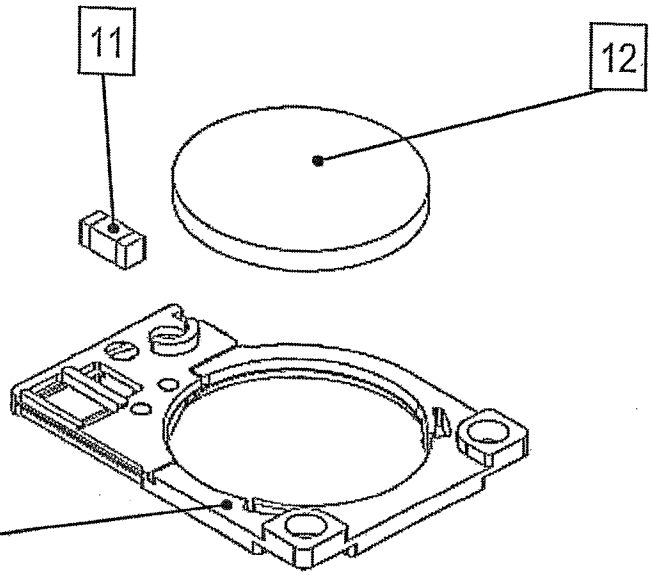
Figure 2A:
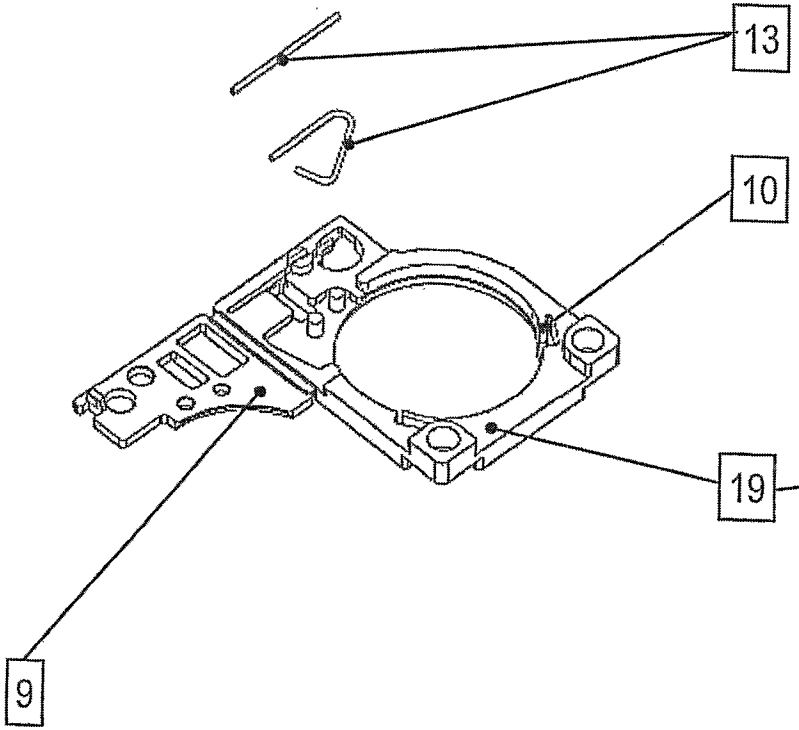
Figure 3:
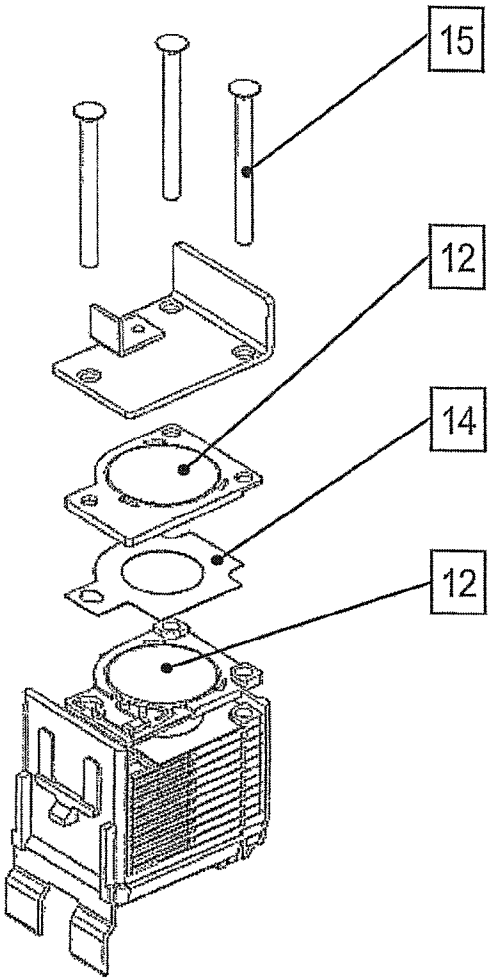
Figure 4:
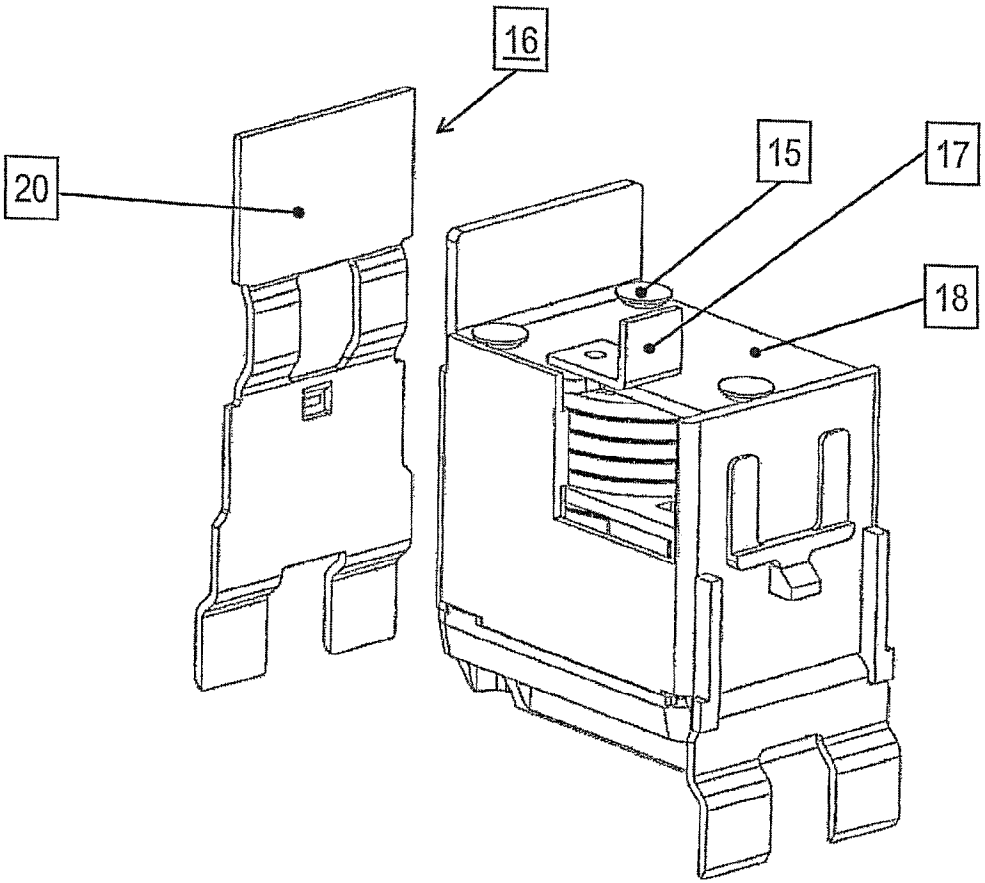

In the figures:

FIG. 1 shows a schematic diagram of a stacked spark gap arrangement according to the prior art;

FIG. 2*a* show an illustration of the inventive insulating body with a film hinge in the and 2*b* opened state (FIG. 2*a*) and in the closed state, with the electrode not yet inserted (FIG. 2*b*);

FIG. 3 shows an illustration of a spark gap overvoltage arrester plug part with a not yet complete stack arrangement of insulating bodies including corresponding electrodes and insulating material discs as well as outlined connecting elements; and FIG. 4 shows an illustration of the complete stacked spark gap with external connections comprising plug contact surfaces, including a tolerance compensation surface on one of the external contacts.

To eliminate the disadvantages of the prior art the invention proposes an ageing-stable lightning current arrester in a follow-current-free configuration, with a low response voltage and residual voltage at the same time. The functional elements of the partial spark gaps, such as graphite discs, control elements and isolating gaps, are designed as individual modules and are decoupled from other loads like pressure and sooting, and are therefore not adversely influenced.

The follow-current-free configuration is based on the series connection of partial spark gaps with additional control elements. Thus, an arrester is obtained in which the flow of a follow current is impossible, even if subjected to a surge current load, as the present reverse voltage of the spark gap is always greater than the applied mains voltage.

The follow-current-free configuration of the inventive arrester brings about several advantages. All essential elements are not exposed to a long-term load in the form of a follow current, and are thus not unnecessarily thermally and/or mechanically loaded. By avoiding a follow current, important functional components inside the arrester may be adapted to the lightning current carrying capacity and the protection level, and dimensioned correspondingly.

A follow-current-free configuration is obtained by a correspondingly dimensioned number of partial spark gaps in a series connection. An individual partial spark gap is preferably comprised of two disc-shaped electrodes and a spacer element, e.g. ring-shaped and of a high-ohmic or insulating material.

The follow-current-free configuration and, thus, the smaller thermal and/or mechanical load on the individual components permits a freer choice of the material and thickness for the respective isolating gaps. By avoiding a follow current, in particular a thermal deformation of or adverse effect on the isolating gap material in the marginal area is avoided, as usually the follow current arcs occur preferably in the form of contracting arcs in the marginal area.

In a simple manner electrodes without an additional outer insulation are used. The projections of the isolating gap material are chosen sufficiently large to avoid spark-overs of individual partial spark gaps and/or the series connection as a whole.

According to an essential aspect of the invention the electrode may also be coated with an outer insulation applied in gap-free manner, e.g. of epoxy resin, technical glass or lacquer, so as to allow a reduction of the required slide distance and air gap inside the arrester.

In order to comply with the normative requirements and the desire for a smallest possible response voltage and residual voltage of the arrangement as a whole the individual partial spark gaps are dimensioned such that the pulse response voltage is less than 1500 V. To allow the realization of such small values the distance between the two electrodes of the respective partial spark gaps is minimized. Due to the inventive follow-current-free configuration the arrester and, thus, the individual electrode discs are mainly loaded with pulsed currents.

Such a pulsed current arc is usually diffuse and has several arc root points, so that there will be no load spots on the electrode surface like in the case of a follow-current arc. The diffuse arc avoids, for instance, a sublimation of the preferably used graphite electrodes, and smaller isolating gap thicknesses may be used without affecting the overall behavior of the arrester. Electrode distances of less than 300 μm have proved to be particularly suitable in this case.

In the solutions according to the prior art, as schematically illustrated in FIG. 1, electrodes 4 and insulating isolating gaps 3 are secured with respect to their position by external guides 5 which are made of an insulating material. This requires a complicated construction with minimum tolerances which, inter alia, renders the assembly more difficult.

The electrodes 4 are in direct contact with the external guides made of an insulating material, so that these guides and the entire insulating holder and, thus, unavoidable slide distances are directly exposed to sooting.

Known arresters of this type can be integrated in a series installation housing, which are frequently formed of a lower part 1 and a pluggable upper part 2. The aforementioned sooting and/or a thermal load is/are even encouraged in the prior art because of occurring follow currents, so that alternative slide distances and spark-over gaps will be utilized, in particular at steep voltage rise rates and as a result of ageing phenomena, with the consequence that the originally desired arrester function is available only to a limited extent.

Individual elements of the stack arrangement are held relative to each other by the external guides, and are provided with separate control boards 6 which have a great error potential. Due to function-related pressure loads, e.g. during a lightning pulse current, such a construction is not capable of ensuring an exact position of the elements relative to each other and/or relative to the control elements. In the prior art, with strongly interlocked disc electrodes 4 and insulating rings 3, with an almost complete sealing there between, the pulse loads, along with the action of the arrester, lead to an unnecessarily high pressure load. The uncontrolled blowing out of residues resulting from the arc burn-off then leads to a direct sooting of the insulating rings, in general with the whole surface area thereof being affected, so that the external spark-over security, which is low anyhow, is further reduced.

In addition, quasi by the breathing of the stack during the load, ionized gas or plasma flows into the particularly spark-over-prone external region in an uncontrolled manner. To allow the previous constructions to go back to the initial state as often as possible, even after high pressure loads, and to allow an irreversible loosening of provided screw connections to take place as delayed as possible, relatively rigid and space-consuming constructions are necessary for fixing the screws. This results in a greater need for space. Due to the interlocked configuration, which is unavoidable in this construction, the external connection electrodes require a thickness that is clearly greater than the one needed for a guidance with no interlocking, where exclusively the pulsed currents have to be controlled. Again, this leads to a greater need for space and an increased material expenditure. Due to the above-described inadequate construction the choice of the material for the isolating gaps and the thickness thereof is strongly limited, so that the available space inside prior housings for series installation devices is further reduced.

Screw connections used so far have one screwing direction 7 which serves to hold the whole stack under a certain initial load. This screwing direction 7 is equal to the pressure direction 7 resulting from the arc. Owing to the same sense of direction a disconnection of the screw connection is nearly unavoidable, depending on the number of loads.

Due to the action of the pressure axis in the stack direction, the expansion of the stack and the required dimensions for a stable holder construction the possibilities of configuring the spark gap according to the prior art as a plug-in module are clearly limited because the necessary insertion forces increase after a number of loads owing to the expansion of the construction, and also because the inevitably occurring tolerance compensation has to be taken into account, which is not the case according to the inventive solution.

Due to the use of contacting elements 8 made of a spring material for the respective control elements it is possible that the individual electrodes 4 are displaced as a result of the so far unavoidable loosening relative to each other and/or relative to the spacer rings held by the same guides, with the consequence that a sufficient distance is not always ensured. Hence, there is the risk of external spark-overs.

In the embodiment according to the invention the isolating gaps or spacer rings, respectively, and the electrodes of the individual partial spark gaps are safely spaced apart from each other, insulated and separately centered.

According to the illustrations shown in FIGS. 2*a* and 2*b* the centering is ensured by using an insulating element or insulating body 19 having a film hinge 9 for each single electrode 12.

Circumferential centering noses, e.g. formed as spring elements 10, which place the individual electrodes 12 in position, are located in a recess of the insulating body 19.

The film hinge 9 provided on each insulating body 19 comprises openings which receive the control elements 11 which are, for instance, designed as surface-mountable components. This means that, in a preferred embodiment, a separate board for mounting necessary control elements, e.g. impedances, varistors etc., is waived so as to preclude an error potential in this regard.

Preferably used ceramic components as control elements 11 may each directly be integrated in the film hinge 9. Contact springs 13, which are required for a reliable contact of the control elements 11 with the individual electrodes 12, and also with a reference potential, are inserted into the film hinge 9, reliably placed in position and held in an insulated manner.

By the circumferential spring elements 10 at the inside of the insulating body 19 the respective electrode 12 is pressed against the respective contact spring 13 and the associated control element 11, so that a spark-free contact is ensured and no susceptible soldered connection is necessary.

The contacting through the circumferential, resilient, elastic, in particular spring elements 10 also allows a partially elastic behavior so as to reliably protect the ceramic control elements 11 against possibly occurring strains and compensate pressure loads.

Using the insulating body 19 with the film hinge 9 ensures a very good overlapping relationship to avoid creep spark-overs, and an optimum centering of the individual electrodes according to the illustration in FIG. 3.

The necessary spacing and, thus, electrical insulation between two successive electrodes 12, which are each centered in separate insulating bodies 19, is ensured by a spacer element or, respectively, plate-shaped or disc-shaped isolating gaps (reference number 14). The corresponding insulating material discs 14 have an opening that points to the respective electrode 12 so as to define the isolating distance or isolating gap, respectively. The insulating material discs may also include an extension section with an adjustment recess to receive adjusting elements, e.g. rivets or screws 15.

Even in the event of an unavoidable pressure load, e.g. as a result of a lightning surge current, which leads to a quasi breathing of the stack arrangement, the elastic and self-centering arrangement of the electrodes 12 and the insulating material discs 14 as well as the respective assignment to the respective control element 11, and thus an intact arrester function with an unchanged low protection level is ensured.

A possible sooting of the insulating body 19 is partially possible merely on the inner edge with which the electrode 12 is in direct contact by the spring elements 10. However, with the preferred use of graphite as electrode material the sooting at this place is unproblematic and does not result in undesired external spark-overs and, thus, in an adversely influenced arrester function.

The centering of the individual electrodes 12 by the in particular integrally formed centering noses or spring elements 10, respectively, allows a nearly circumferential air gap which might, in addition, absorb sooting particles, without a total sooting of the inner edge or outer edges of the insulating body taking place.

Neither the vertical nor the horizontal isolating gaps are directly sooted as the soot can escape into uncritical areas.

The circumferential air gap may also serve as a compensation space in the event of pressure increases resulting from the function-related loads. Also, if required, additional vent channels may be integrated in the individual elements, e.g. electrodes and isolating gaps of the stack.

The insulating material discs 14 are constructed to receive aforementioned screws or rivets as guide elements 15, which are required for the preliminary adjustment of the stack arrangement, and are insulated sufficiently from other elements exposed to potential by corresponding deflections inside the insulating material disc in the longitudinal and lateral axes. Due to correspondingly integrated deflections and the controlled deposition of soot at surfaces especially designed for this purpose direct sliding discharges are, therefore, impossible.

The isolating element which is formed by the insulating material discs 14 realizes the necessary distance gap and a reliable insulation of the successive electrodes 12, the associated control elements 11 and the necessary contact springs. Preferably, an easy to fabricate stamped element made, for instance, of vulcanized fiber with a corresponding thickness is used in this case.

An isolating gap material of this type is still dimensionally stable despite the required small thicknesses of ≤300 μm and easy to use in the production and for the assembly. In particular, such a material is also dimensionally stable in the event of thermal loads and only has a small flow tendency. Furthermore, vulcanized fiber is resistant to tears and breakage when exposed to mechanical and thermal impacts, and is insensitive to mechanical strains in all axes.

By the integration of the control elements 11 and the contact springs 13 in the film hinge 9 of the insulating body 19, the separate guidance and centering of the individual graphite discs in the electrodes 12 in this insulating body, the separate dimensioning and positioning of the insulating material discs 14 relative to the graphite disc and the insulating body 19 it is possible to realize the mechanical interlocking force for achieving the functionally sensible gap freedom between the electrode and the isolating gap, without the breathing of the components along with the action of the arrester leading to a displacement of the individual elements, to the sooting of the isolating gaps or to any other damages.

According to the invention the pressure load cannot cause damage to the connections, the individual elements and to the position of the components relative to each other. Also, the unavoidable emission of soot and ionized gas does not result in undesired spark-overs at the relevant component or isolating gaps.

The structure as proposed, which is not dependent on axial or radial tolerances, nearly precludes any risk of damaging components, regardless of the number of partial spark gaps. The construction according to the invention, which overcomes the constructive disadvantages of the prior art, allows the construction of stacked spark gaps with clearly more partial spark gaps (at least about 30%) while the outer construction space remains unchanged.

Due to the increase of the number of partial spark gaps permitted by the inventive construction the residual voltage of the spark gap is possibly increased. To avoid this, use is being made of the correlation between the geometric capacitances of the construction and/or the materials used. In the embodiment according to the invention a longitudinal capacitance of the arrangement is calculated on the basis of the preferably used isolating gap material depending on the respective thickness and construction in respect of the individual partial spark gaps. A capacitance value which is at least 5 to 10 times greater than the longitudinal capacitance calculated before is then used as the control element for a preferably non-linear voltage distribution over the total series connection. From the second partial spark gap to the second last partial spark gap equal control elements with the calculated capacitance value are being used.

At least on the last partial spark gap of the stack arrangement the associated control capacitance is, again, greater by a factor 5 to 10 times than the other control capacitances so as to provide a sufficiently great energy supply at this point, with the result that the spark gap as a whole is reliably ignited through and the residual voltage drops as compared to a conventional dimension with equal control elements, so that the required protection level is always reliably complied with.

The resulting longitudinal capacitances are each dependent on the isolating gap material used, the thickness thereof and the construction as a whole, so that the control elements to be optimally used are to be adapted to the respective new conditions when the construction is modified.

The risk of individual control elements being overloaded is avoided by employing elements that have an electric strength, which preferably corresponds at least to the occurring protection level of the whole arrester.

With such a configuration of a stacked spark gap by means of control elements it is achieved that the ratio of the maximally occurring residual voltage over the whole arrester to the normatively determined response surge voltage is always less than 2.5. Moreover, the spark gap including the control system is to be dimensioned such that a failure of up to 10% of the partial spark gaps, including and excluding the control system, is uncritical for the overall function of the arrester in the application environment.

If unpredictable overloads occur, e.g. outside the specified range, when individual elements or isolating gaps are overloaded, the proposed structure of the stack arrangement and/or the configuration of the control elements effectively prevent(s) the propagation of the spark, i.e. a chain reaction and thus a total spark-over without additional protective measures, such as encapsulation.

To allow a simple and confusion-proof assembly of the arrester the insulating material bodies 19 with film hinges 9 are differently color-coded and prefabricated as individual units.

The color coding allows a differentiation of all controlled electrodes according to odd and even partial spark gaps.

The first one of the partial spark gaps, which is configured passively, is inserted into a separate outer housing.

With respect to the other film hinges for the even and odd partial spark gaps with equal control elements the last partial spark gap of the stack arrangement, which is controlled with an increased capacitance value, is again coded and marked by another color. In addition, a control element of a different, and thus confusion-proof SMD construction size is used.

The insulating material bodies 19, which are for instance color-coded, including film hinges 9 are stacked corresponding to the desired voltage in a most simple manner, with the insulating material discs 14 placed there between.

The insulating material bodies 19 including the film hinges 9 center the preferred disc electrodes 12 and, for instance by corresponding guiding noses, also the high-ohmic or insulating spacer elements or isolating gap elements (insulating material discs 14) which are preferably fabricated in the form of stamped elements.

The stack arrangement is preferably adjusted by means of guide elements 15, wherein according to the illustration shown in FIG. 4 one of the two plug contacts 16 contacts the stack by a so-called Tox connection, i.e. clinching technique.

On the one hand, such a Tox connection allows the joining of components without additional auxiliary means. On the other hand, the tolerances inevitably occurring in such a stacked construction can be compensated by a tolerance compensation surface 20.

The above allows a free choice of the number of partial spark gaps within the construction size predefined by the outer housing, without modification components or additional components and with an equivalent structure. An adaptation of plug contacts to be possibly used is not necessary as these tolerances are not influenced by the opposite stack direction, so that a good plug-in capability is provided, even in an aged condition.

The above-mentioned tolerance compensation and the centering of the electrodes allows a fast and cost-efficient modification of the isolating gap material and/or the isolating gap thickness and/or the number of isolating gaps, and thus an adaptation to other arrester requirements.

Basically, it is possible to arrange the control elements in the overall arrester further offset with respect to each other along the electrode circumference.

By integrating the control elements in the insulating film hinge, and by the advantages associated therewith, additional space is provided so that pluggable solutions as series installation device can be realized even for higher voltages.

As an extension it is proposed in one embodiment to provide a temperature-dependent indicator in direct thermal contact to the disc electrodes 12.

In this case it is assumed that the greatest temperature development is in the middle of the stack arrangement, and the corresponding conditions with respect to thermal capacity and thermal conduction of the surrounding components are taken into account. In this regard, a thermally sensitive element 17 is positioned in the region of the terminating electrode 18.

If an additional heat dissipation is necessary it is also possible to form, for instance, the insulating material bodies of a heat conducting plastic material or ceramics. For instance, a solder, wax, or an adhesive may be used as thermally sensitive element 17. If the outer electrode reaches a temperature outside a specified operating range a preloaded indicator (not shown) is released, for instance, by the melting of the thermally sensitive element. The indicator provides an information about a thermal overload of the spark gap either directly or by a remote signaling.

Summarizing, it is once more pointed out that in order to guarantee a reproducible and ageing-stable response voltage of the partial spark gaps it is necessary to provide a gap-free connection between the disc electrodes 12 and the respective insulating material disc 14. This is obtained by the disc electrodes 12 having at least the same thickness as the respective insulating material bodies 19. Thus, it is ensured that the axial pressure load is always built up via the disc electrodes 12 and the insulating material disc 14, and not via the insulating material body 19. Moreover, the clamping connection of the disc electrodes in the insulating material body does not fix the disc rigidly, neither axially nor in a radial position. Even if the individual components are wrongly assembled in the insulating material element this guarantees an automatic, functionally reliable alignment of the components after the complete assembly of the whole stack arrangement. This results in an advantageous configuration and construction which is largely independent of existing axial tolerances of the individual components, ensuring a gap-free contact and, thus, a reproducible low and ageing-stable response voltage, wherein measures for avoiding the external spark-overs can be realized at the same time.

The above was achieved by dividing the stack into a sequence of individual insulating discs and insulating bodies, and the integration of a disc electrode, a control element and the contacting means for the control element in an insulating body. The guide elements of the whole stack arrangement always ensure the required pressurized connection between the disc electrodes and the insulating discs, regardless of the number of the sections and the tolerances of the individual elements.

The described embodiment with a radial centering serves a better assembling capability and better fixation of the outer projections of the insulating disc and the inner recess of the insulating disc relative to the disc electrodes. Thus, a cost-efficient application of the electrode material and the insulating disc is achieved.

The invention claimed is:

1. Spark gap comprising a number of series-connected individual spark gaps which are placed in a stack arrangement, which are spaced apart from each other by insulating material discs and are provided with a spring contact, the individual spark gaps including ring-shaped or disc-shaped electrodes, and further comprising control elements for influencing the voltage distribution over the stack arrangement, characterized in that the ring-shaped or disc-shaped electrodes required to form one of the respective individual spark gaps are each inserted into an insulating body and held by same in a centered manner, with the respective insulating material disc being located between and fixed by the insulating bodies, and that a recess is provided inside the insulating body to receive and center the electrodes, whose shape is complementary relative to the contour of the respective electrode, wherein the recess comprises on the inner circumference at least partially elastic, resilient centering projections or centering noses.

2. Spark gap according to claim 1, characterized in that the respective insulating bodies comprise a radial prolongation which receives at least one contact spring for contacting the respective electrode in particular at the edge, wherein the contact spring projects partially into the recess.

3. Spark gap according to claim 2, characterized in that the respective insulating body comprises a film hinge part, in particular in the region of the radial prolongation, which can be moved from an opened position into a closed position, wherein the film hinge part includes at least one hole or opening to receive at least one of the respective control elements.

4. Spark gap according to claim 1, characterized in that at least one of the respective control elements is electrically coupled through the at least one contact spring.

5. Spark gap according to claim 4, characterized in that at the radial prolongation, spaced apart from the contact spring, a receptacle for another spring-type contact element is provided, wherein the distance and the position between the end of the contact spring away from the electrode and the other contact element corresponds to the position of the connections of the respective control element.

6. Spark gap according to claim 1, characterized in that the centering by the centering noses or centering projections provides for a circumferential air gap between the respective electrode and the respective insulating body.

7. Spark gap according to claim 1, characterized in that complementary position-securing projections and/or recesses are formed, in particular integrally foamed, on the insulating bodies on the upper and lower sides in the stack.

8. Spark gap according to claim 1, characterized in that the insulating material discs include an opening pointing to the respective electrodes to form a distance gap or isolating gap.

9. Spark gap according to claim 8, characterized in that the insulating material discs include an extension section with an adjustment recess.

10. Spark gap according to claims claim 1, characterized in that the insulating material discs each have a thickness of substantially ≤300 μm.

11. Spark gap according to claim 1, characterized in that at least parts or portions of the insulating body are made of a thermally conducting plastic material.

12. Spark gap according to claim 1, characterized in that the electric strength of the control elements is greater than or equal to the maximally occurring protection level.

13. Spark gap according to claim 1, characterized in that the impedance value of at least some of the respective control elements is five to ten times greater than the longitudinal capacitance of the stack arrangement.

14. Spark gap according to claim 1, characterized in that the insulating bodies and/or the film hinge are at least partially color-coded.

15. Spark gap according to claim 1, characterized in that a thermally sensitive overload indicator is provided.

* * * * *